US007249563B2

(12) United States Patent
Chen et al.

(10) Patent No.: US 7,249,563 B2
(45) Date of Patent: Jul. 31, 2007

(54) MECHANISM FOR FOLDING A TABLE LEG

(75) Inventors: Harry Chen, Taichung Hsien (TW); Lung-Chuan Huang, Taichung Hsien (TW)

(73) Assignee: E - Make Co., Ltd. (TW)

( * ) Notice: Subject to any disclaimer, the term of this patent is extended or adjusted under 35 U.S.C. 154(b) by 277 days.

(21) Appl. No.: 11/022,472

(22) Filed: Dec. 23, 2004

(65) Prior Publication Data

US 2006/0191448 A1 Aug. 31, 2006

(51) Int. Cl.
*A47B 3/00* (2006.01)

(52) U.S. Cl. ..... 108/129; 108/133; 248/439

(58) Field of Classification Search ..... 108/132, 108/133, 131, 129, 130, 115, 117; 248/188.6, 248/439

See application file for complete search history.

(56) References Cited

U.S. PATENT DOCUMENTS 3,396,928 A * 8/1968 Lay ..... 108/129
3,554,141 A * 1/1971 Burr ..... 108/132
3,857,343 A * 12/1974 Greenberg ..... 108/133
4,144,822 A * 3/1979 Roberts et al. ..... 108/129
4,573,415 A * 3/1986 Ramey ..... 108/129
4,735,392 A * 4/1988 Farmer ..... 108/133
6,386,119 B1 * 5/2002 Lin ..... 108/133
6,394,005 B1 * 5/2002 Isensee et al. ..... 108/132
7,066,099 B2 * 6/2006 Tseng ..... 108/132

* cited by examiner

*Primary Examiner*—José V. Chen
(74) *Attorney, Agent, or Firm*—Connolly Bove Lodge & Hutz

(57) ABSTRACT

A mechanism for folding one of at least three legs of a table to a tabletop thereof is disclosed. The mechanism includes a bracket secured to the bottom of the tabletop, a stand as a main portion of each leg pivotally connected to the bracket by a pivot, and a spring having one end connected to an upper pivotal shaft and the other end connected to the lower pivot such that lifting an outer end of the shaft about the other end thereof by one hand and pivoting the stand clockwise about the bracket by the other hand will fold the stand under the tabletop.

1 Claim, 6 Drawing Sheets

MECHANISM FOR FOLDING A TABLE LEG

BACKGROUND OF THE INVENTION

1. Field of the Invention

The present invention relates to a table, and more particularly to a mechanism for folding a table leg.

2. Description of Related Art

Some conventional tables in accordance with the prior art comprise multiple foldable legs. However, the conventional folding devices usually have a complicated structure such that the manufacturing cost is raised. As a result, the consumer needs to pay more money for buying the conventional table. For reducing the manufacturing cost of table and simplifying the structure of the conventional folding device, the conventional table needs to be advantageously altered.

The present invention has arisen to mitigate and/or obviate the disadvantages of the conventional tables that have multiple foldable legs.

SUMMARY OF THE INVENTION

The main objective of the present invention is to provide an improved mechanism for folding one of at least three legs of a table to a tabletop thereof.

To achieve the objective, the mechanism in accordance with the present invention includes a bracket secured to the bottom of the table top, a stand as a main portion of each leg pivotally connected to the bracket by a pivot, and a spring having one end connected to an upper pivotal shaft and the other end connected to the lower pivot such that lifting an outer end of the shaft about the other end thereof by one hand and pivoting the stand clockwise about the bracket by the other hand will fold the stand under the tabletop.

Further benefits and advantages of the present invention will become apparent after a careful reading of the detailed description with appropriate reference to the accompanying drawings.

DETAILED DESCRIPTION OF THE INVENTION

Figure 1:
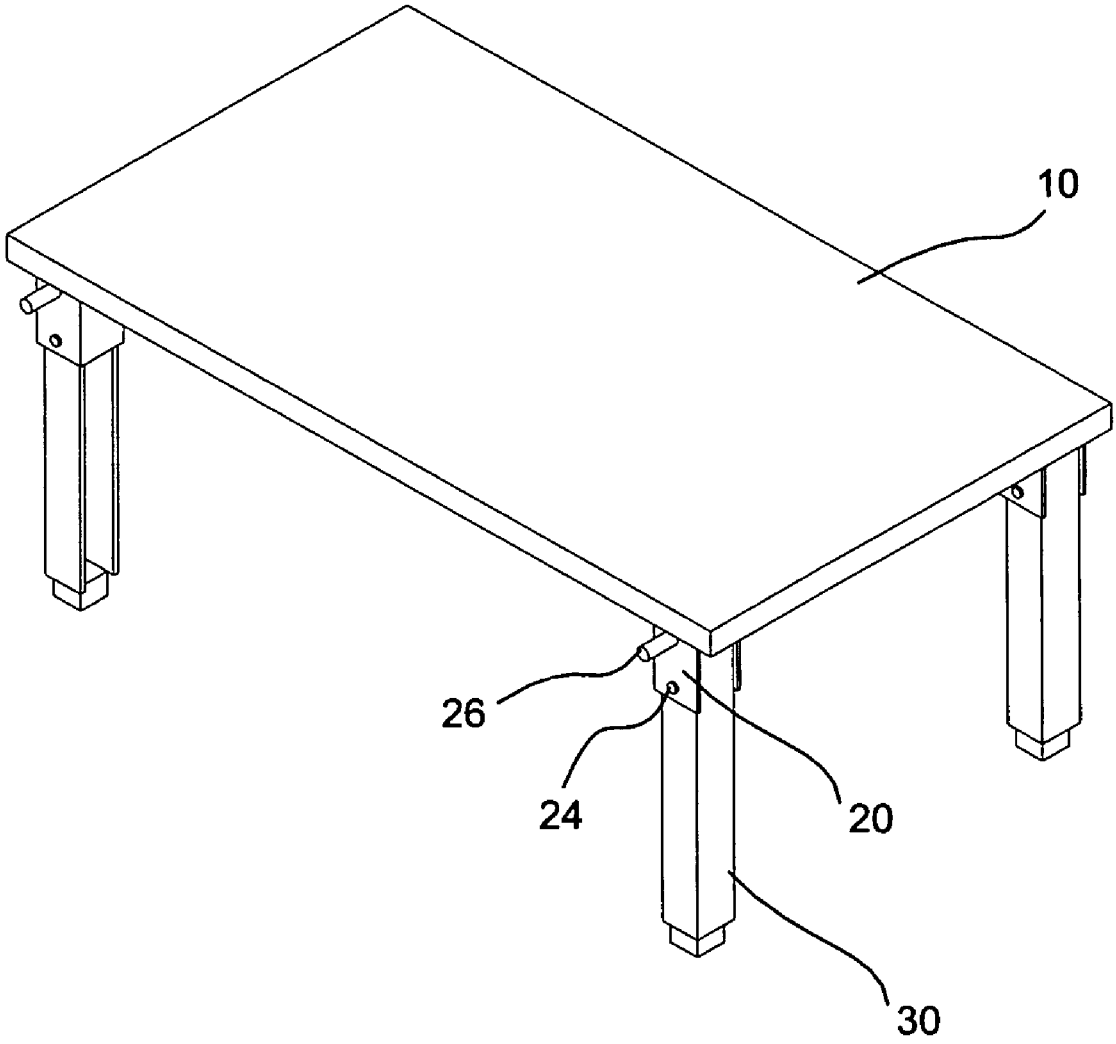
FIG. 1 is a perspective view of a worktable in accordance with the present invention.
Figure 2:
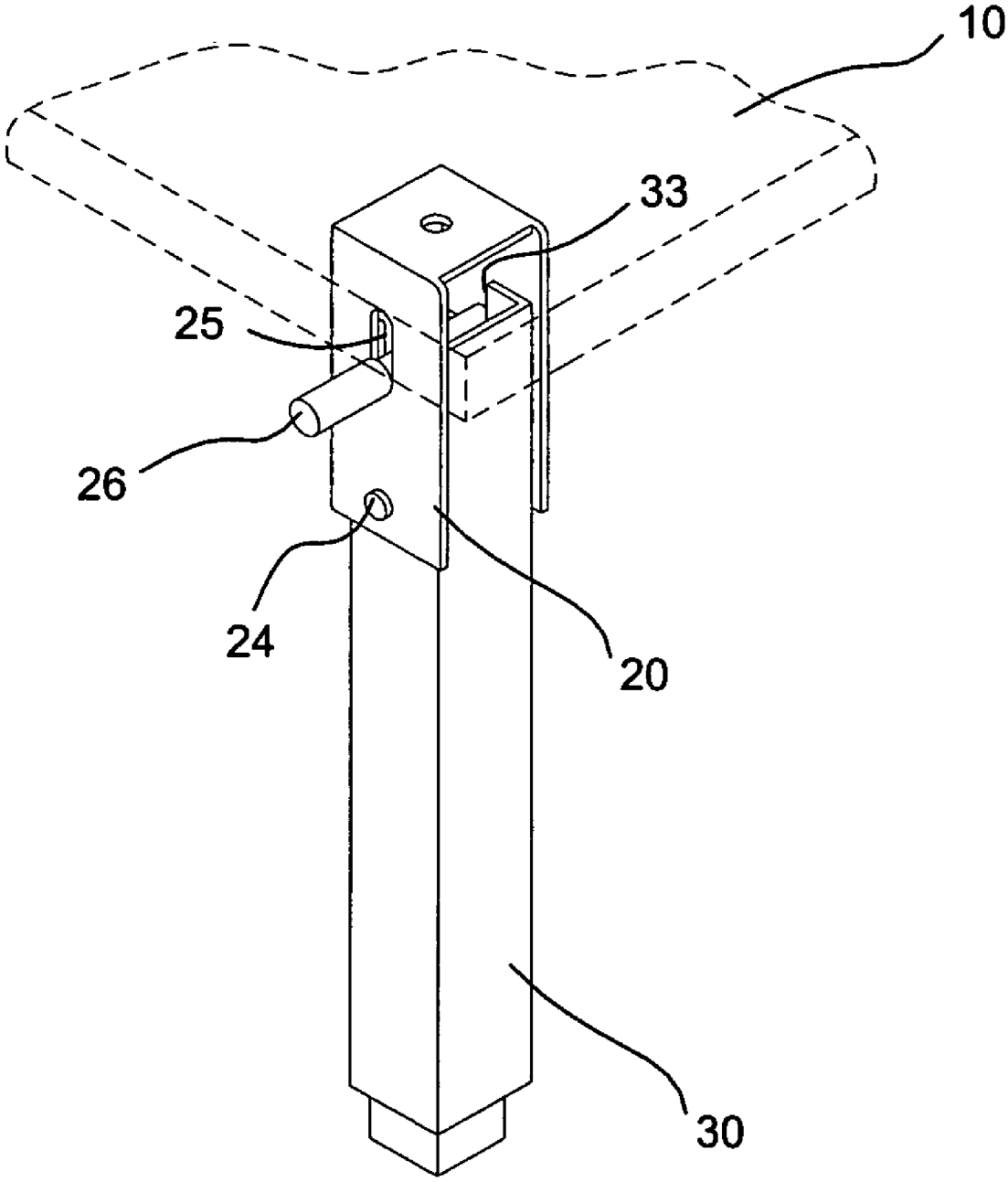
FIG. 2 is a perspective view of a foldable leg of the worktable in FIG. 1.
Figure 3:
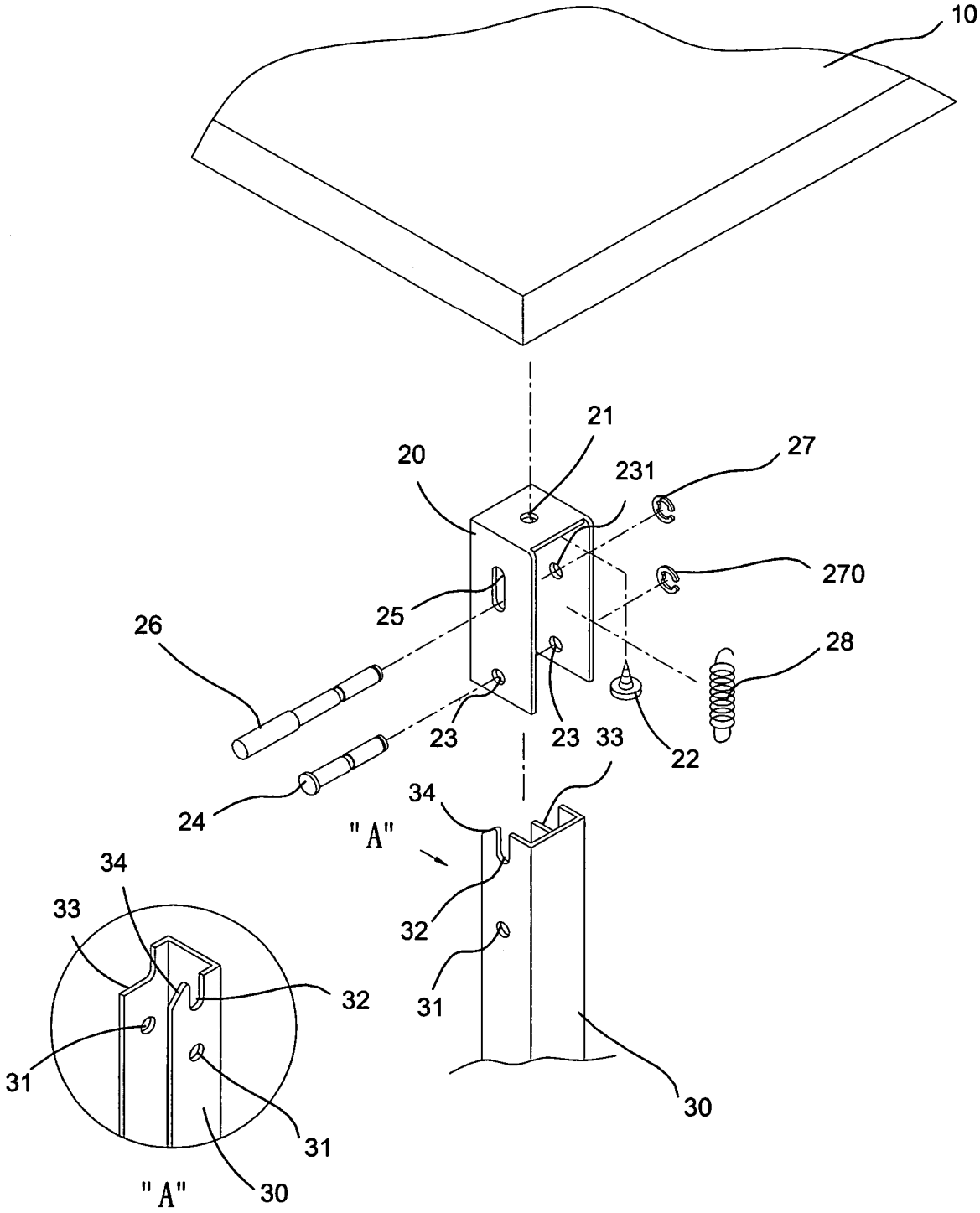
FIG. 3 is an exploded perspective view of the foldable leg in FIG. 2.
Figure 4:
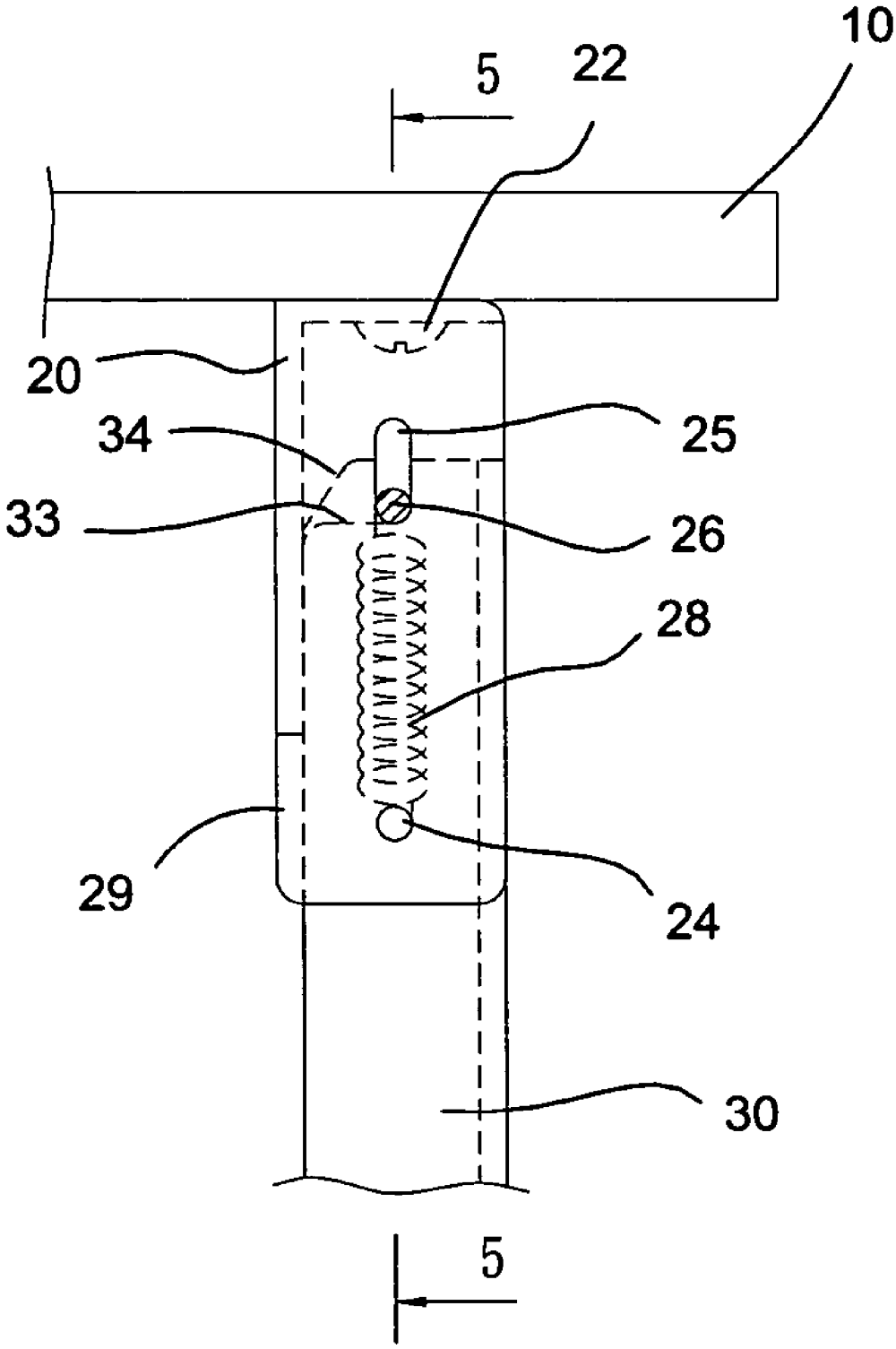
FIG. 4 is a side plan view of the foldable leg in FIG. 2.
Figure 5:
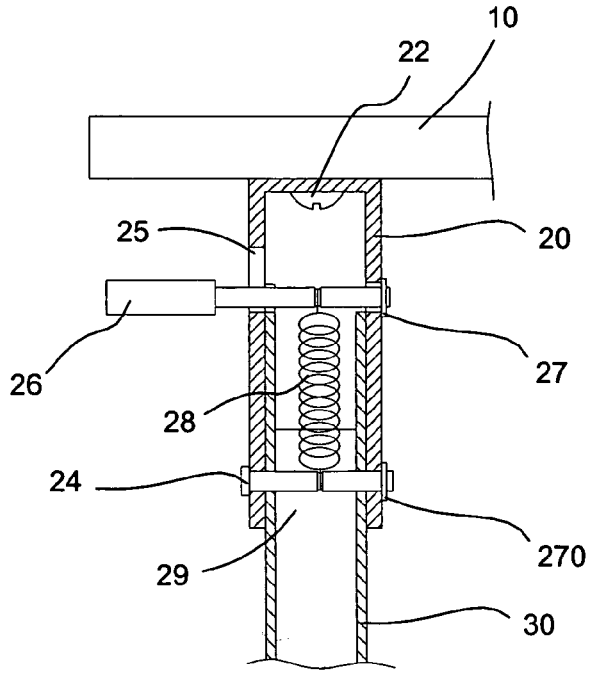
FIG. 5 is a cross-sectional view of the foldable leg in FIG. 4 along Line 5-5.

Referring to the drawings and initially to FIGS. 1-5, a table incorporating a leg folding mechanism Each foldable leg comprises a bracket (20) secured mounted to the bottom of the tabletop (10) by a screw (22) that extends through a through hole (21) defined in a top of the bracket (20) and is screwed into the bottom of the tabletop (10), and a stand (30) pivotally connected to and selectively positioned in the bracket (20).

The bracket (20) has a first side plate (not numbered), a second side plate (not numbered) opposite to the first side plate of the bracket (20) and a back (not numbered) for connecting the first side plate and the second plate of the bracket (20). A first through hole (23) is defined in and laterally extending through the first side plate and the second side plate near a lower end of the bracket (20). A bore (231) is defined in the first side plate of the bracket (20), and a slot (25) is longitudinally defined in the second side plate of the bracket (20) and linearly corresponds to the bore (231). A shaft (26) sequentially extends through the slot (25) and bore (231). A first locking member (27) is mounted to a distal end of the shaft (26) after the shaft (26) extending through the bore (231) to prevent the shaft (26) from detaching from the bracket (20). A pivot (24) extends through the bracket (20) via the first through hole (23) to pivotally mount the stand (30) to the bracket (20) after a top portion of the stand (30) being received in the bracket (20). A second locking member (270) is mounted to a first end of the pivot (24) to prevent the pivot (24) from detaching from the bracket (20) and the second end of the pivot (24) is enlarged. A resilient member (28) has two opposite ends respectively connected to the shaft (26) and the pivot (24) for providing a restitution force to the shaft (26) after the shaft (26) being upwardly pulled. In the preferred embodiment of the present invention, the resilient member (28) is a spring. A valley (29) is defined in a lower end of the back of the bracket (20) for selectively partially receiving the stand (30) when being folded.

The stand (30) has a second through hole (31) laterally defined therein for allowing the pivot (24) extending therethrough. The stand (30) has a first side plate (not numbered) and a second side plate (not numbered) opposite to each other, and respectively corresponding to the first side plate and the second side plate of the bracket (20). A groove (32) is defined in the second side plate of the stand (30). The shaft (26) is engaged in the groove (32) when the stand (30) is stretched to support the tabletop (10). A cutout (33) is defined in the first side plate of the stand (30) to allow the shaft (26) extend through the stand (30). A guiding side (34) is formed on an inward top of the second side plate of the stand (30) for guiding the shaft (26) moved into the groove (32) when stretching the stand (30).

Figure 6:
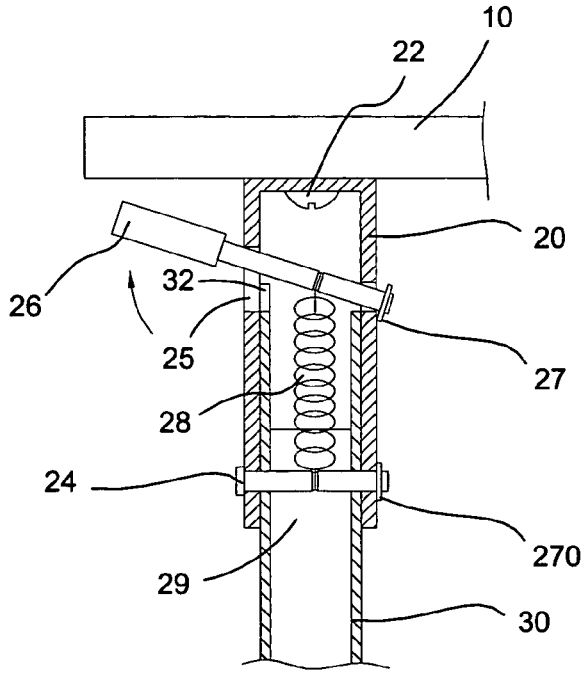
FIG. 6 is a first operational view of the foldable leg of the worktable of the present invention.
Figure 7:
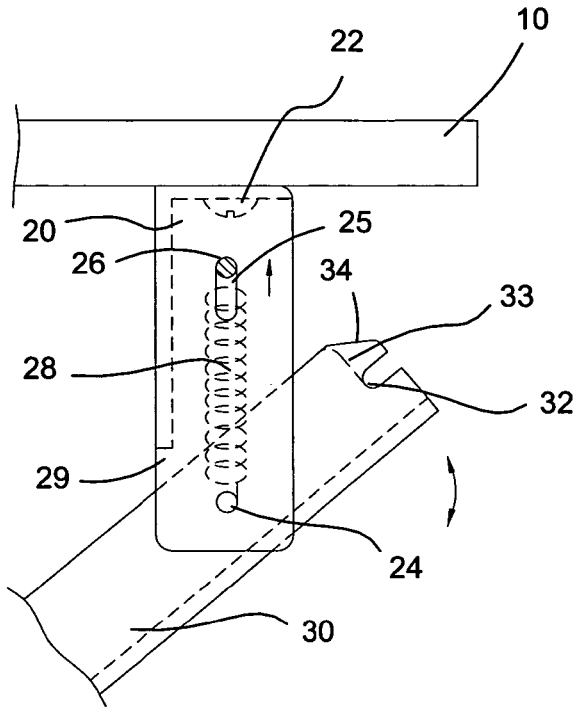
FIG. 7 is a second operational view of the foldable leg of the worktable of the present invention.
Figure 8:
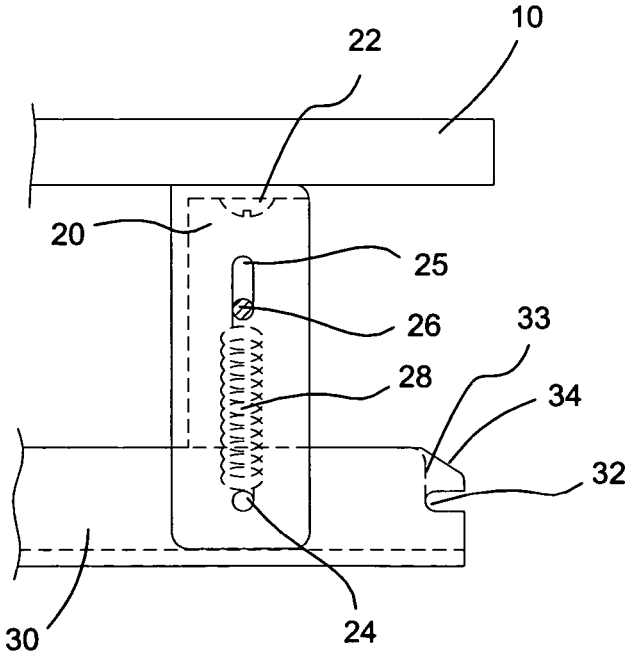
FIG. 8 is a third operational view of the foldable leg of the worktable of the present invention.

With reference to FIGS. 5-8, when folding the stand (30), the shaft (26) is upwardly pulled and disengaged to the groove (32) such that the user can inwardly wrench the stand (30), and make the stand (30) partially received in the valley (29) and parallel to the bottom of tabletop (10) for achieving the purpose of reducing the volume of the worktable after being used. The guide side (34) upwardly pulls the shaft (26) that lengthens the resilient member (28) when stretching the stand (30) to support the tabletop (10). The shaft (26) automatically engages to the groove (32) for stably supporting the tabletop (10) due to the restitution force of the resilient member (28) when the stand (30) is perpendicular relative to the bottom of the tabletop (10).

Although the invention has been explained in relation to its preferred embodiment, it is to be understood that many other possible modifications and variations can be made without departing from the spirit and scope of the invention as hereinafter claimed.

What is claimed is:

1. A mechanism mountable on a table including a tabletop and at least three legs, comprising:

a bracket secured on a bottom of the tabletop; and a stand pivotally mounted to the bracket and served as a main portion of each leg, wherein:

the bracket includes a first side plate, a second side plate opposite to the first side plate of the bracket, a back for connecting the first side plate and the second plate of the bracket, a first through hole defined in and laterally extending through the first side plate and the second side plate near a lower end of the bracket, a bore defined in the first side plate of the bracket, a slot longitudinally defined in the second side plate of the bracket and linearly corresponding to the bore, a shaft sequentially extending through the slot and the bore, a first locking member mounted to a distal end of the shaft after the shaft extending through the bore to prevent the shaft from detaching from the bracket, a pivot extending through the bracket via the first through hole to pivotally mount the stand to the bracket after a top portion of the stand being received in the bracket, the pivot having an enlarged second end, a second locking member mounted to a first end of the pivot to prevent the pivot from detaching from the bracket, a spring having both ends secured to the shaft and the pivot respectively, and a valley defined in a lower end of the back of the bracket for selectively partially receiving the stand when being folded; and the stand includes a second through hole laterally defined therein for allowing the pivot extending therethrough, a first side plate, a second side plate opposite to the first side plate, a groove defined in the second side plate of the stand with, the shaft engaged in the groove when the stand is stretched to support the tabletop, a cutout defined in the first side plate of the stand to allow the shaft extend through the stand, and a guiding side formed on an inward top of the second side plate of the stand for guiding the shaft to move into the groove when stretching the stand.

* * * * *